United States Patent [19]

Sakuma

[11] 4,143,510

[45] Mar. 13, 1979

[54] ANALOGUE ELECTRONIC TIMEPIECE WITH SETTING MEANS

[75] Inventor: Tadashi Sakuma, Tokyo, Japan

[73] Assignee: Kabushiki Kaisha Daini Seikosha, Japan

[21] Appl. No.: 788,014

[22] Filed: Apr. 15, 1977

[30] Foreign Application Priority Data

Apr. 16, 1976 [JP] Japan ..... 51-43906

[51] Int. Cl.[2] ..... G04B 27/08

[52] U.S. Cl. ..... 58/85.5; 58/23 R; 58/23 A; 58/23 D

[58] Field of Search ..... 58/23 R, 23 A, 23 D, 58/34, 85.5

[56] References Cited

U.S. PATENT DOCUMENTS

| | | | |
|---|---|---|---|
| 2,990,676 | 7/1961 | Jensen | 58/85.5 |
| 3,363,410 | 1/1968 | Imahashi | 58/34 |
| 3,548,587 | 12/1970 | Wood | 58/85.5 X |
| 3,693,344 | 9/1972 | Cleusix | 58/85.5 X |
| 3,972,178 | 8/1976 | Beguin | 58/85.5 |

*Primary Examiner*—Ulysses Weldon

*Attorney, Agent, or Firm*—Robert E. Burns; Emmanuel J. Lobato; Bruce L. Adams

[57] ABSTRACT

In an analogue electronic timepiece comprising a minute hand mounted on a cannon pinion, an hour hand mounted on an hour wheel, a motor driven by pulses produced by an electronic circuit and a gear train connecting the motor pinion with the cannon pinion and hour wheel, means for setting the minute hand and hour hand to amend the time displayed by the timepiece comprises a setting wheel which is rotatable by a crown wheel in one direction for moving the hands clockwise and in the opposite direction for moving the hands counterclockwise. The setting wheel is coupled to the gear train by a friction pinion at a point in the train which is approximately midway between the motor pinion and the cannon pinion and hour wheel so that the blacklash generated in moving the hands clockwise in a setting operation is approximately equal to the backlash generated in moving the hands counterclockwise. The electronic circuit includes means for generating pulses at the conclusion of a setting operation so as to compensate for the blacklash in the gear train. Since the backlash is approximately the same regardless of the direction the hands are moved in the setting operation substantially complete compensation for the backlash can be attained regardless of the direction in which the hands are moved.

6 Claims, 7 Drawing Figures

ANALOGUE ELECTRONIC TIMEPIECE WITH SETTING MEANS

FIELD OF INVENTION

This invention relates to an analogue electronic timepiece and particularly to means for setting the hands of the timepiece in order to amend the time displayed.

BACKGROUND OF THE INVENTION

A conventional quartz crystal timepiece uses a gear train comprising the rotor pinion of a motor driven by pulses supplied by the electronic circuitry of the timepiece, a fourth gear, a fourth wheel pinion, a third gear, a third pinion and a center wheel and pinion on which the minute hand is mounted. When the hands of the timepiece are adjusted in a counterclockwise direction in a hand setting operation the engaging condition of the gear train remains the same as in the driving condition. No backlash develops. However, in case the hands are adjusted clockwise a backlash is generated in the gear train. When the rotor pinion starts to rotate after a clockwise hand setting adjustment the center wheel and pinion carrying the minute hand does not move until all of the backlash between the gears of the gear train has taken up. In a two-hands timepiece this effects an error in the setting while in a center seconds-hand timepiece it causes a divergence of the minute and second hands. This is disadvantageous since usually the hands of a timepiece are moved clockwise in a setting operation.

SUMMARY OF THE INVENTION

It is an object of the present invention to remove the above mentioned disadvantages by reducing the error of time delay to a minimum in case of both clockwise and counterclockwise handsetting adjustement of a two-hands quartz crystal timepiece. In accordance with the invention the time equivalent of the backlash in the gear train generated in a counterclockwise hand-setting adjustment it is almost the same as in a clockwise hand-setting adjustment. In both instances the time equivalent of the backlash is minimized. Moreover, at the conclusion of a hand-setting adjustment driving pulses corresponding to the backlash of the gear train are generated by the electronic circuitry and supplied to the motor so as to compensate for the backlash.

BRIEF DESCRIPTION OF DRAWINGS

The nature, object and advantages of the invention will be more fully understood from the following description in accordance with the accompanying drawings in which.

DESCRIPTION OF PRIOR ART

Figure 1:
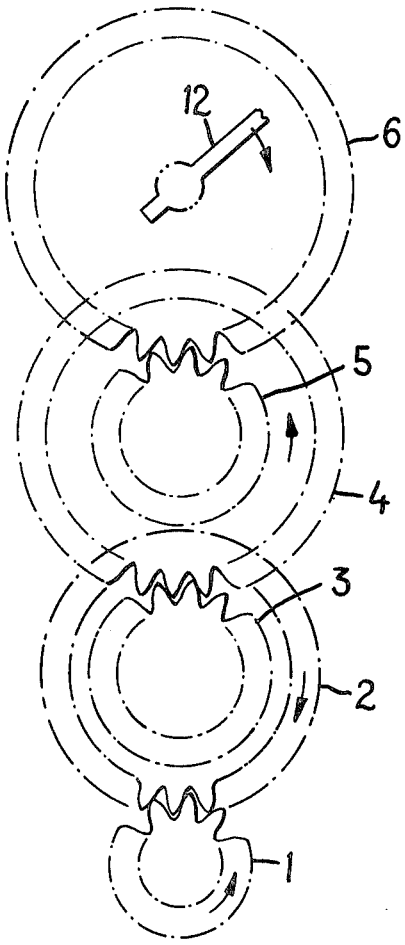
FIG. 1 is a schematic representation of the gear train of a quartz crystal timepiece in normal operating condition.

A gear train of a conventional quartz crystal timepiece ti is shown schematically in FIG. 1. The gear train comprises a rotor pinion 1 of a motor driven by pulses supplied from the electronic circuitry of the timepiece, a fourth gear 2, a fourth wheel pinion 3, a third gear 4, a third pinion 5, a center wheel and pinion 6 on which a minute hand 12 is mounted. The direction of rotation of the gears in normal operation is indicated by arrows. FIG. 1 shows the engaging condition of the gears of the gear train in normal operation. It will be seen that the leading faces of the gear teeth of the rotor pinion 1 are in engagement with the trailing faces of the gear teeth of the fourth gear 2, the leading faces of the teeth of fourth wheel pinion 3 are in engagement with the trailing faces of the teeth of the third gear 4 and the leading faces of the teeth of the third pinion 5 are in engagement with the trailing faces of the teeth of the center wheel and pinion 6.

Figure 2:
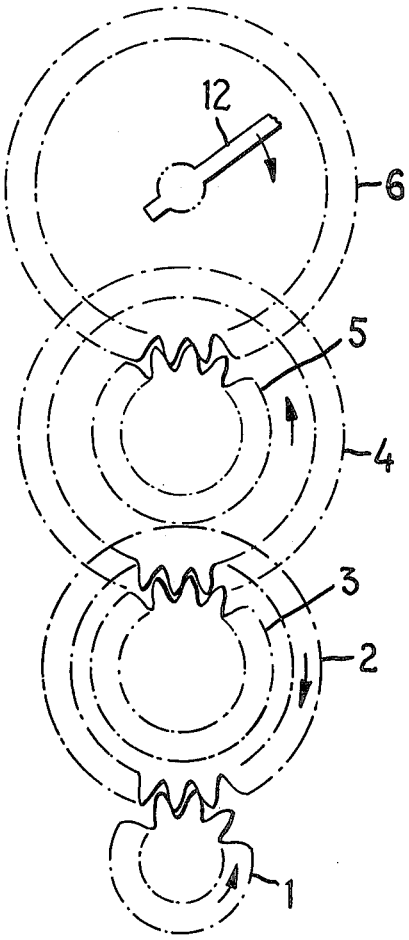
FIG. 2 shows the engaging condition of the gears of the gear train when the hands are adjusted clockwise.

When the hands of the timepiece are adjusted counterclockwise in a hand-setting operation the engaging condition of the gear train remains the same as is shown in FIG. 1 as the rotor pinion 1 is stopped. However, in case the hands of the timepiece are adjusted clockwise the backlash of the gear train becomes the condition shown in FIG. 2 which is in contrast to FIG. 1. Generally when a quartz crystal timepiece is started after hand-setting adjustment the rotor pinion 1 starts to rotate after a second. However, because of the backlash generated in a clockwise hand-setting adjustment, as illustrated in FIG. 2, the center wheel and pinion 6 and hence the minute hand 12 do not move until the backlash between each of the gears of the gear train has been completely taken up even though the rotor pinion 1 rotates. In a two-hands timepiece this effects a "delay" which appears as an error in the setting of the timepiece. In a center second hand timepiece it causes a divergence of the minute hand and second hand. In either event it is disadvantageous since the hands of a timepiece are usually adjusted clockwise in a hand-setting operation.

DESCRIPTION OF PREFERRED EMBODIMENT

The present invention aims to remove the above mentioned disadvantages. This is accomplished by the means illustrated in FIGS. 3 to 7. As illustrated by way of example in FIG. 3 the gear train of a timepiece in accordance with the present invention comprises a rotor pinion 1 which is concentric with the motor of the timepiece, a fourth gear 2, a fourth wheel pinion 3, a third gear 4, a third wheel pinion 5, and a center wheel and pinion 6. A friction pinion 7 which is fitted frictionally to the axis of the center wheel and pinion 6 drives a minute gear 9 which in turn drives a cannon pinion 10 on which there is mounted a minute hand 12. The cannon pinion 10 is of the same diameter as the friction pinion 7. A minute pinion 8 which is integral with the minute gear 9 drives an hour wheel 11 on which an hour hand 13 is mounted.

A setting wheel 14 engages with the friction pinion 7. The setting wheel 14 is rotatable in either direction by a clutch wheel 15 which engages with the setting wheel 14 at the time of hand-setting adjustment.

Figure 3:
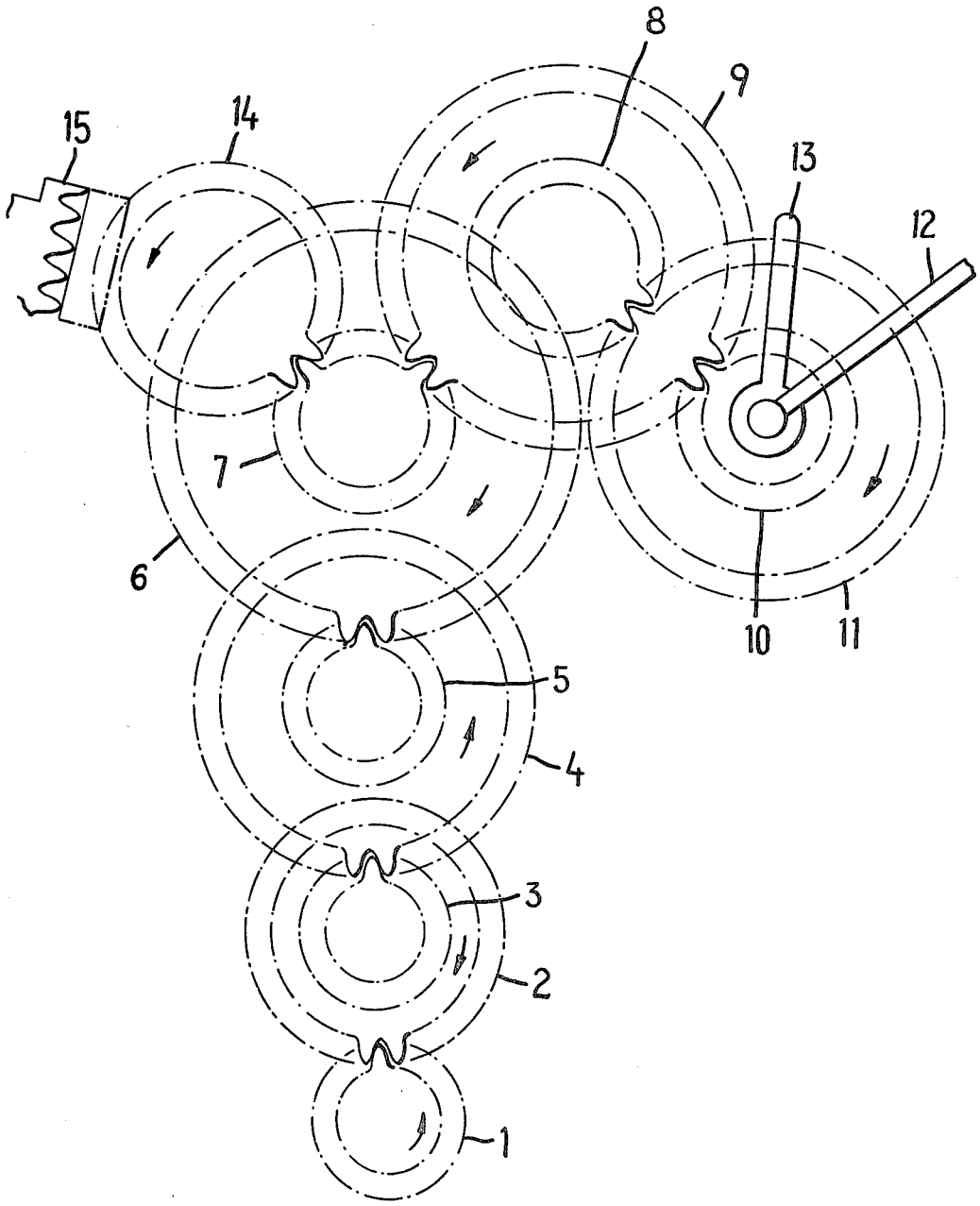
FIG. 3 is a schematic illustration of the gear train of a quartz crystal timepiece according to the present invention in operating condition.

FIG. 3 shows the engagement of the gears of the gear train in normal operating conditions. All backlash in the transmission train from the rotor pinion 1 to the cannon pinion 10 is taken up in the right direction.

Figure 4:
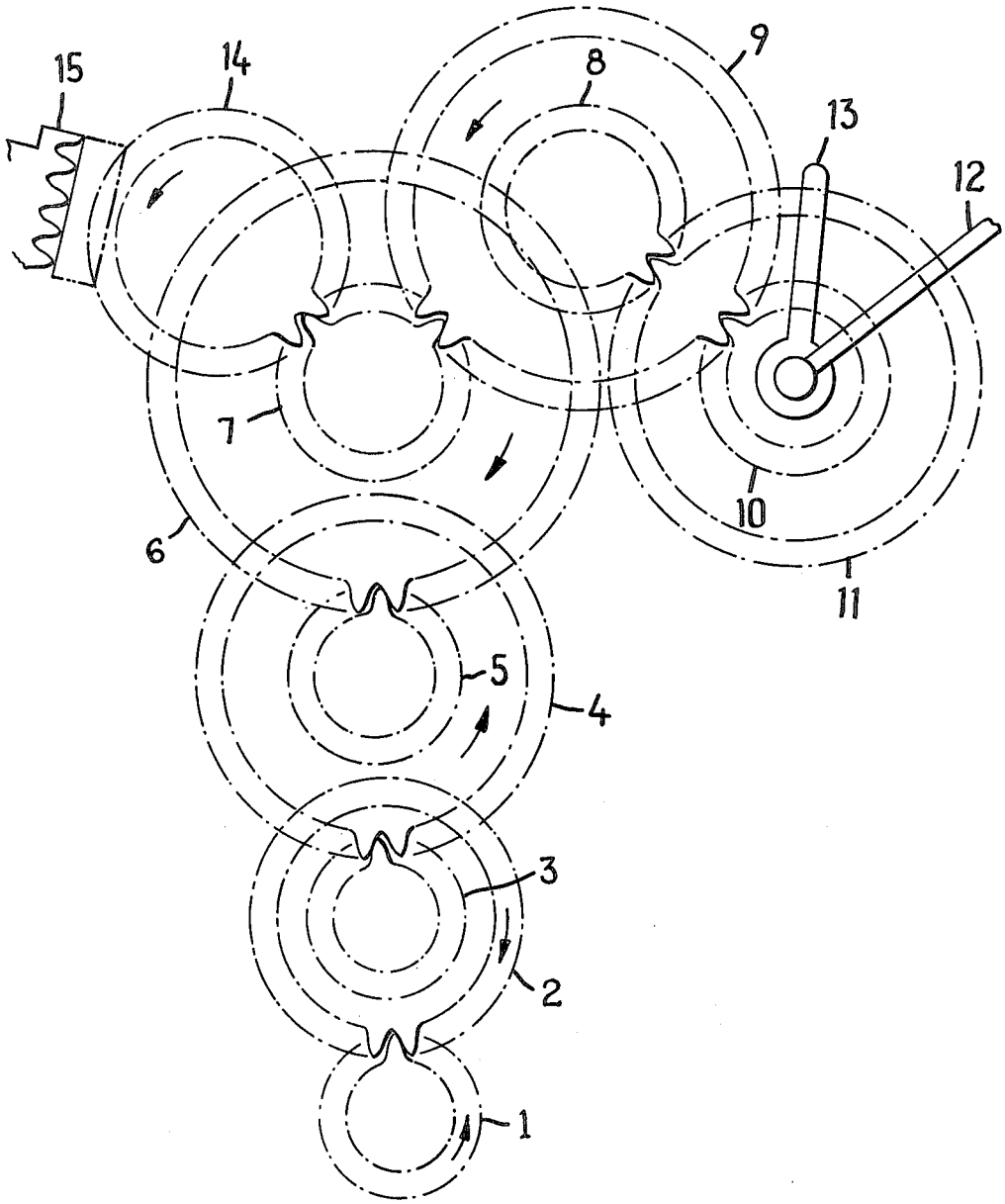
FIG. 4 shows the engaging conditions of the gears of the gear train of FIG. 3 when the hands are adjusted clockwise in a hand-setting operation.
Figure 5:
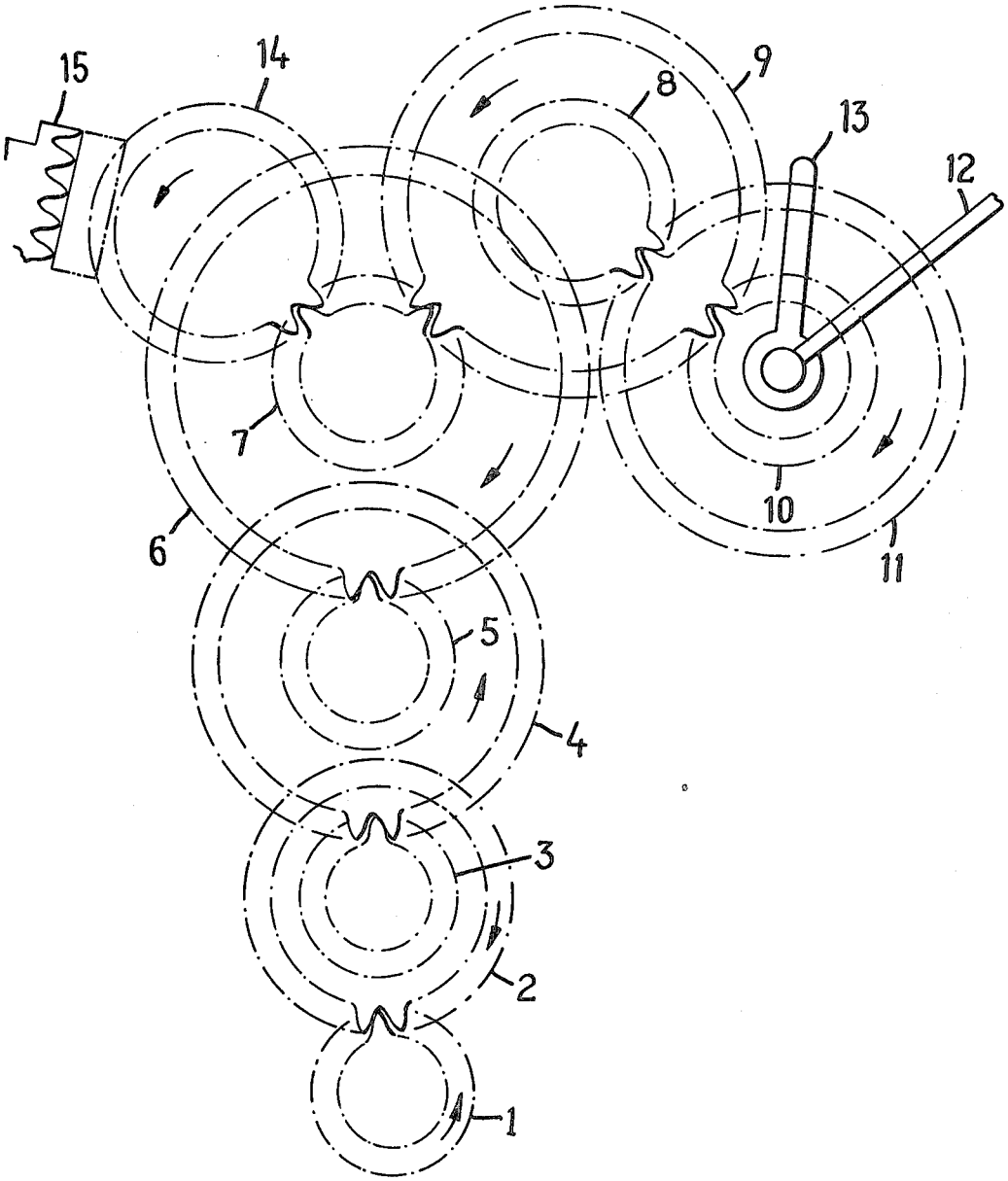
FIG. 5 shows the engaging condition of the gears of the gear train when the hands are adjusted counterclockwise.

The condition of the backlash of each of the gears in hand-setting operations is illustrated in FIGS. 4 and 5. The setting of the hands is effected by rotation of the setting wheel 14 in one direction or the other by means of the clutch wheel 15. When the hands are adjusted clockwise by rotation of the setting wheel 14 in a counterclockwise direction, as illustrated in FIG. 4, the backlash between the gears from the rotor pinion 1 to the center wheel and pinion 6 are in contrast to the normal operating condition as shown in FIG. 3. However, engagement of the gears from the friction pinion 7 to the cannon pinion 10 is the same as in FIG. 3.

When the hands are adjusted counterclockwise by rotation of the setting wheel 14 in a clockwise direction the gears assume the condition illustrated in FIG. 5. It will be seen that the backlash between the gears from the friction pinion 7 to the cannon pinion 10 are in contrast to the normal operating condition while engagement of the gears from the rotor pinion 1 to the center wheel and pinion 6 is the same as in the normal operating condition illustrated in FIG. 3. Since the center wheel and pinion 6 and friction pinion 7 are approximately at a midpoint of the gear train the amount of backlash generated in the gear train from the rotor pinion 1 to the cannon pinion 10 is approximately the same irrespective of the direction of the hand-setting adjustment.

Figure 6:
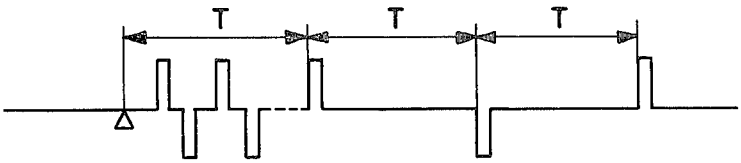
FIG. 6 is a chart showing a motor driving pulse according to the present invention.

After the hand-setting adjustment the cannon pinion 10 starts to move after the rotor pinion 1 rotates several times. To avoid the resulting delay in rotation of the cannon pinion 10 after a hand-setting adjustment the electronic circuitry of the timepiece is designed to apply driving pulses as shown in FIG. 6 to the motor at the conclusion of the hand-setting operation. In FIG. 6 the mark Δ indicates the reset removing point and T designates a motor driving period. T is determined by the constitution of the gear train mechanism of the timepiece and may for example be 1 second, 2 seconds, 5 seconds, or the like. The number of driving pulses generated during the first period T after the reset is removed is determined according to the rotation of the rotor pinion 1 which is required to compensate for the backlash in the gear train after the hand-setting adjustment. Furthermore the tooth profile of each of the gears of the gear train should be so designed that taking into consideration the engaging condition of the gears in the hand-setting adjustment the backlash after hand-setting adjustment as illustrated in FIGS. 4 and 5 is compensated by the same rotation of the rotor pinion 1. The backlash in the gear train generated by the hand-setting adjustment can thus be compensated instantaneously by the electrical driving pulses and a correct hand-setting adjustment of the timepiece is realized.

Figure 7:
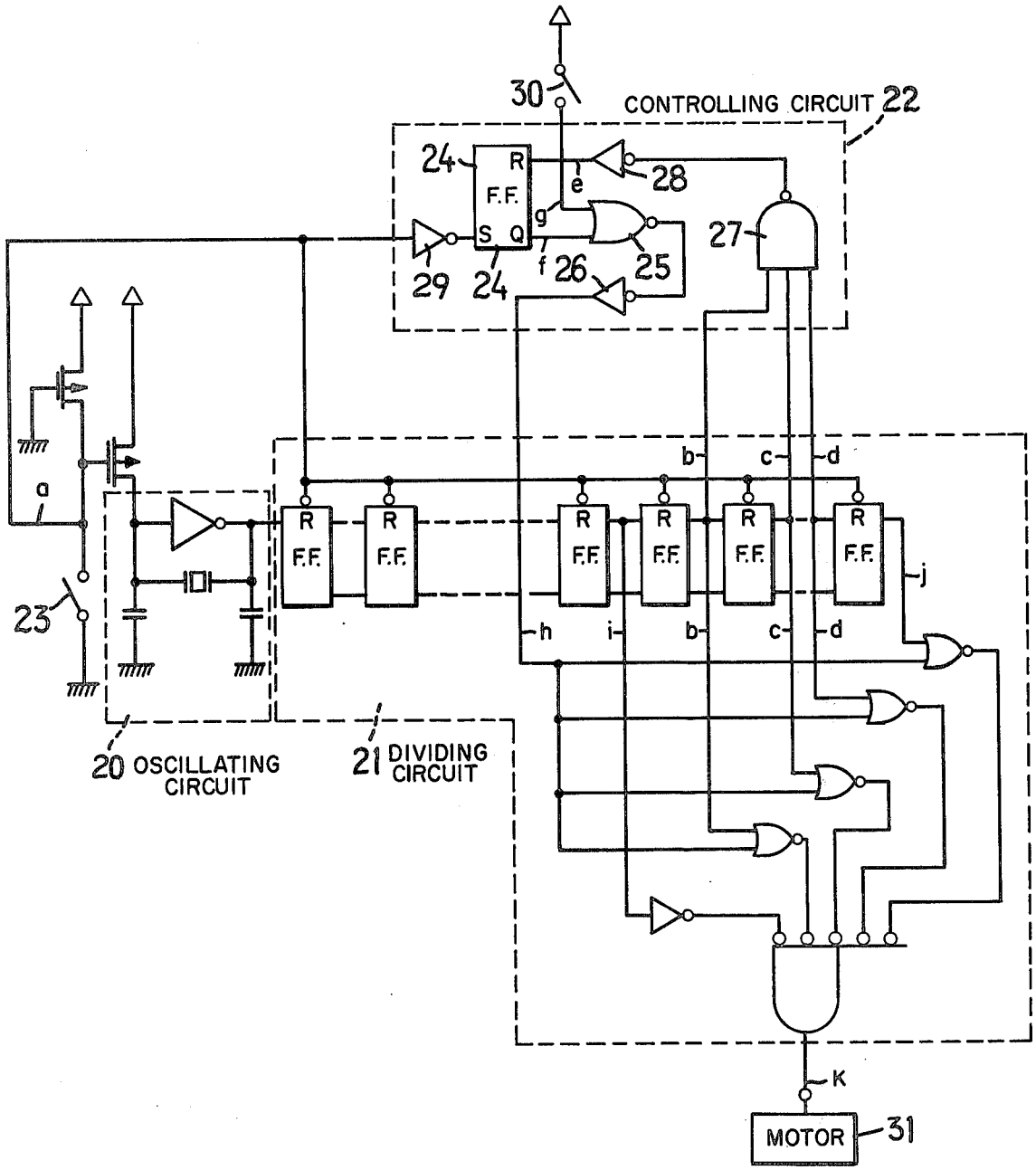
FIG. 7 is a circuit diagram of the electronic circuitry of the timepiece.

Circuitry for producing the driving pulses for compensating the backlash as shown in FIG. 6 is illustrated in FIG. 7. The circuitry is shown as comprising an oscillating circuit 20, a dividing circuit 21, a controlling circuit 22 and a switch 23 for actuating the controlling circuit. Assuming the timepiece to be a watch in which the hand-setting adjustment is effected by means of the watch stem, the switch 23 is actuated by movement of the stem. The controlling circuit 22 comprises an RS flipflop 24, a NOR gate circuit 25, an inverter circuit 26, a NAND gate circuit 27 and inverter circuits 28 and 29, as illustrated in FIG. 7. When the switch 23 is closed the S terminal of the flipflop 24 is connected to ground through the inverter circuit 29. The three input terminals of NAND circuit 27 are connected with terminals b, c and d of the dividing circuit 21. The output terminal of NAND circuit 27 is connected through the inverter 28 to the R terminal of the flipflop 24. The output terminal Q of the flipflop 24 is connected through the NOR gate circuit 25 and inverter circuit 26 to input terminals of four NOR gate circuits of the dividing circuit 21. A second input terminal of the NOR gate circuit 25 is connected through a speedy feed switch 30 to a voltage source. Accordingly the controlling circuit 22 is operated with signals of the dividing circuit 21 and the signal of switch 23 so that the dividing circuit 21 receives the output signal of the controlling circuit 22.

Assuming that the switch 23 is in OFF state when the electronic timepiece is in normal operation, the switch 23 comes to be in the ON state during the hand-setting procedure whereby the terminal a comes to be in the state of logic level "0." After the hand-setting adjustment is made, the switch 23 comes to be in the OFF state whereby terminal a comes to be in the state of logic level "1." Accordingly the dividing circuit 21 having a plurality of dividing stages starts to count from the reset state.

At this time the output signal f of the RS flipflop 24 comes to be in the state of logic level "1" and the terminal h becomes in the state of logic level "1." Accordingly an output pulse train controlled by the terminal i of the dividing circuit 21 is produced from the output terminal k and fed to the motor 31, the rotor pinion 1 of which drives the hands of the timepiece through the gear train described above.

When the terminals b, c and d are in the state of logic level "1," the terminal f becomes in the state of logic level "0" since the RS flipflop 24 is actuated when the output terminal of of the inverter 28 namely the terminal e becomes in the state of logic level "1."

Although in FIG. 7 the counter used is the dividing circuit 21 it is possible to use another counter if desired.

When the terminal f comes to be in the state of logic level "0" the terminal h comes to be in the state of logic level "0." Accordingly the normal output pulse train is produced from the terminal k, namely the AND output signal of the terminal i, b, c, d and j produced from the terminal k.

Assuming that the terminal k is put in the state of logic level "1" by the operation of the speedy feed switch 30 a pulse train is produced from the output terminal k of the dividing circuit in the same manner as the pulse train is produced from the terminal k when the switch 23 changes from ON state to OFF state.

Thus in the first period T after the reset removing point which is designated Δ in FIG. 6 the circuitry of FIG. 7 produces a rapid series of driving pulses which are fed to the motor 31. The number of the driving pulses generated during the first period T after removal of reset corresponds to the rotation of the rotor pinion 1 of the motor 31 required to compensate for the backlash of the gear train in the hand-setting adjustment. Furthermore the backlash after the second hand adjustment in FIGS. 4 and 5 is made is compensated for by the rotation of the rotor pinion 1. The teeth of the respective gears of the gear train are so designed that taking into consideration the engaging condition of the gears, as illustrated in FIGS. 4 and 5, the backlash is substantially the same for clockwise adjustment of the hands and for counterclockwise adjustment. Hence the compensation provided by the circuitry of FIG. 7 is correct for clockwise as well counterclockwise adjustment of the hands in the hand-setting operation.

It will thus be seen that according to the present invention a correct hand-setting adjustment of the quartz crystal timepiece is guaranteed irrespective of the direction of the hand-setting adjustment.

While the invention is also applicable to other analogue electronic timepieces it is particularly advantageous for electronic wristwatches. While a preferred embodiment of the invention has been illustrated in the drawings and is herein particularly described it will be understood that modification and variations may be made and that hence the invention is in no way limited to the illustrated embodiments.

What is claimed is:

1. An analogue electronic timepiece comprising a minute hand mounted on a cannon pinion, an hour hand mounted on an hour wheel, an electric motor having a rotor and rotor pinion, electronic circuit means for producing periodic pulses at a predetermined rate and delivering said pulses to said motor to drive it, a speed-reducing gear train connecting said rotor pinion with said cannon pinion and said hour wheel, said gear train comprising a train of intermeshing gears having backlash between successive gears of said gear train, and means for manually setting both of said minute hand and hour hand to amend the time displayed by said timepiece, said setting means comprising a setting wheel and means for rotating said setting wheel in one direction to move said hands clockwise and for rotating said setting wheel in the opposite direction to move said hands counterclockwise, and means coupling said setting wheel with said gear train approximately midway between said rotor pinion and said cannon pinion and hour wheel so that the total backlash generated in moving said hands clockwise by said setting means in a setting operation is approximately equal to the backlash generated in moving said hands counterclockwise by said setting means in a reverse setting operation, said electronic circuit means comprising means controlled by said setting means and operable at the conclusion of the manual setting operation automatically to supply a predetermined number of extra pulses to said motor at a rate faster than the rate of said periodic pulses to compensate for the backlash in said gear train.

2. An analogue electronic timepiece according to claim 1, in which said coupling means comprises a friction pinion coaxial with an intermediate gear of said gear train and frictionally coupled therewith, said friction pinion meshing with said setting wheel.

3. An analogue electronic timepiece according to claim 2, in which said means for rotating said setting wheel comprises a clutch wheel engageable with said setting wheel only during the setting operation.

4. An analogue electronic timepiece according to claim 1, in which said circuit means for said producing periodic driving pulses comprises an oscillating circuit for producing a standard signal and a multistage dividing circuit for dividing said standard signal including an end stage delivering said drive pulses to said motor and in which said means for supplying extra signals comprises a controlling circuit controlling said dividing circuit and switch means operable by said setting means to activate said controlling means to control said dividing circuit to supply pulses from an intermediate stage of said dividing circuit to said motor to drive said motor at a faster than normal rate.

5. An analogue electronic timepiece according to claim 1, in which said gear train connecting said rotor pinion with said cannon pinion comprises a fourth gear, a fourth wheel pinion, a third gear, a third wheel pinion, a center wheel and pinion, and a minute gear and pinion, and in which said setting means comprises a friction pinion which is fitted frictionally to the axis of said center wheel and pinion and meshes with said setting wheel.

6. An analogue electronic timepiece comprising a minute hand mounted on a cannon pinion, an hour hand mounted on an hour wheel, an electric motor having a rotor and rotor pinion, electronic circuit means for producing periodic pulses at a predetermined rate and delivering said pulses to said motor to drive it, a speed-reducing gear train connecting said rotor pinion with said cannon pinion and hour wheel, said gear train comprising a train of intermeshing gears having predetermined backlash between successive gears of said gear train and means for manually setting both of said minute hand and hour hand to amend the time displayed by said timepiece, said setting means comprising a setting wheel and means to reset said hands, and means coupling said setting wheel with said gear train between said rotor pinion and said cannon pinion and hour wheel for setting said hands by said setting means, backlash being generated in said gear train by the manual setting operation, said electronic circuit means for producing periodic drive pulses comprising an oscillating circuit for producing a standard signal, a multistage dividing circuit for dividing said standard signal including an end stage delivering normal drive pulses to said motor and a controlling circuit controlling said dividing circuit and switch means operable by said setting means to activate said controlling means to control said dividing circuit automatically to supply a predetermined number of extra pulses from an intermediate stage of said dividing circuit to said motor at a faster rate than said normal drive pulses at the conclusion of the manual setting operation to compensate for the backlash generated in said gear train by said manual setting operation.

* * * * *